US006449979B1

(12) United States Patent
Nagasawa et al.

(10) Patent No.: US 6,449,979 B1
(45) Date of Patent: Sep. 17, 2002

(54) REFRIGERANT EVAPORATOR WITH REFRIGERANT DISTRIBUTION

(75) Inventors: Toshiya Nagasawa, Obu; Eiichi Torigoe, Anjo; Masamichi Makihara, Gamagori, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/596,896

(22) Filed: Jun. 19, 2000

(30) Foreign Application Priority Data

Jul. 2, 1999 (JP) ..... 11-189407

(51) Int. Cl.[7] ..... F25B 43/00
(52) U.S. Cl. ..... 62/503
(58) Field of Search ..... 62/503, 498, 499, 62/500, 501, 502, 504, 507, 509, 519, 523, 525, 515; 165/153, 174, 152

(56) References Cited

U.S. PATENT DOCUMENTS

| | | | | |
|---|---|---|---|---|
| 4,252,752 A | * | 2/1981 | Flandroy | |
| 4,589,265 A | * | 5/1986 | Nozawa | 62/526 |
| 5,651,268 A | * | 7/1997 | Aikawa et al. | 62/525 |
| 5,678,422 A | * | 10/1997 | Yoshii et al. | 62/513 |
| 5,701,760 A | * | 12/1997 | Torigoe et al. | 62/524 |
| 5,862,676 A | * | 1/1999 | Kim et al. | 62/197 |
| 5,901,785 A | * | 5/1999 | Chiba et al. | 165/174 |
| 5,931,020 A | * | 8/1999 | Nakamura | 62/527 |
| 5,979,547 A | * | 11/1999 | Shinmura et al. | 165/174 |
| 5,996,899 A | * | 12/1999 | Watanabe et al. | 236/92 B |
| 6,209,202 B1 | * | 4/2001 | Rhodes et al. | 29/890.053 |
| 6,220,340 B1 | * | 4/2001 | Cheong et al. | 165/103 |
| 6,227,290 B1 | * | 5/2001 | Nishishita et al. | 165/174 |
| 6,257,322 B1 | * | 7/2001 | Toh et al. | 165/104.12 |

FOREIGN PATENT DOCUMENTS

| | | |
|---|---|---|
| EP | 0 683 373 A1 | 11/1995 |
| EP | 0 769 665 A2 | 4/1997 |
| EP | 0 849 557 A1 | 6/1998 |
| JP | A-6-26780 | 2/1994 |
| JP | B2-7-39895 | 5/1995 |
| JP | Y2-2518259 | 9/1996 |
| JP | A-10-281684 | 10/1998 |
| JP | A11-287587 | 10/1999 |

* cited by examiner

*Primary Examiner*—Teresa Walberg
*Assistant Examiner*—Daniel Robinson
(74) *Attorney, Agent, or Firm*—Harness, Dickey & Pierce, PLC

(57) ABSTRACT

An evaporator has plural tubes arranged in parallel with each other in a width direction perpendicular to an air flowing direction. The tubes are further arranged in two rows in the air flowing direction, and tank portions extending in the width direction are also arranged in the two rows in the air flowing direction to correspond to the tubes. A refrigerant inlet and a refrigerant outlet are provided in the tank portions, respectively, at one side end in the width direction, so that refrigerant flows through all one-row tubes after passing through the other-row tubes. In the evaporator, throttle holes are provided in a distribution portion of the tank portions, for distributing refrigerant, so that a refrigerant distribution within the tubes can be arbitrarily set. Thus, air temperature blown out from the evaporator can be made uniform.

12 Claims, 12 Drawing Sheets

REFRIGERANT EVAPORATOR WITH REFRIGERANT DISTRIBUTION

CROSS-REFERENCE TO RELATED APPLICATION

This application is related to and claims priority from Japanese Patent Application No. Hei. 11-189407 filed on Jul. 2, 1999, the contents of which are hereby incorporated by reference.

BACKGROUND OF THE INVENTION

1. Field of the Invention

The present invention relates to an evaporator of a refrigerant cycle, in which a refrigerant distribution can be suitably set. The evaporator is suitable for a vehicle air conditioner, for example.

2. Description of Related Art

A refrigerant evaporator 110 having refrigerant passages shown in FIG. 19 is proposed in JP-Y2-2518259. The refrigerant evaporator 110 has plural tubes 100 each of which has two parallel refrigerant passages 100*a,* 100*b* therein, and first and second tanks 101, 102 formed independently from the tubes 100. One side refrigerant passage 100*a* communicates with the first tank 101, and the other side refrigerant passage 100*b* communicates with the second tank 102. A partition plate (not shown) is provided at a middle position of the first tank 101 in a tank longitudinal direction, so that the first tank 101 is partitioned into an inlet tank portion 101*a* for distributing refrigerant into the tubes 100 and an outlet tank portion 101*b* for collecting refrigerant from the tubes 100. The first tank 101 is disposed at an upstream side from the second tank 102 in an air flowing direction A. Further, a refrigerant inlet 103 is provided in the inlet tank portion 101*a,* and a refrigerant outlet 104 is provided in the outlet tank portion 101*b*. The refrigerant passage 100*a* defines upstream passages F1 and F4 provided at an upstream air side, and refrigerant passage 100*b* defines downstream passages F2 and F3 provided at a downstream air side.

In the evaporator 110, refrigerant from the refrigerant inlet 103 flows through refrigerant passages in a refrigerant flow direction shown by arrows in FIG. 19, and is discharged to an outside from the refrigerant outlet 104. When gas-liquid two-phase refrigerant flows toward the left side within the second tank 102 in FIG. 19, liquid refrigerant readily flows toward the leftmost side within the second tank 102 due to the inertia force rather than gas refrigerant. Therefore, a liquid refrigerant ratio becomes higher at a left side of the refrigerant passage F3, and the temperature of air blown out from the evaporator 110 becomes ununiform.

In the conventional refrigerant evaporator 110, throttle means is provided at the left side of the second tank 102 in FIG. 19, so that the quantity of the liquid refrigerant flowing toward the leftmost side of the second tank 102 is smaller in the evaporator 110, refrigerant almost gasified in the refrigerant passages F1, F2 flows into the refrigerant passages F3, F4 on the left side in FIG. 19, and air passing through the tubes 100 around the refrigerant passages F3, F4 is difficult to be cooled. As a result, in this case, a temperature difference of air blown from the evaporator 110 becomes larger between left and right sides.

SUMMARY OF THE INVENTION

In view of foregoing problems, it is an object of the present invention to provide an evaporator having a uniform temperature distribution of blown-air.

According to the present invention, in a refrigerant evaporator, a plurality of tubes are arranged in parallel with each other in a width direction perpendicular to a flow direction of air (outside fluid) and are arranged in plural rows in the flow direction of air, and plural tanks are disposed at both upper and lower ends of each tube to have upper tank portions and lower tank portions. The tanks are arranged to correspond to the arrangement of the tubes in the plural rows in the flow direction of air. The tanks have an inlet through which refrigerant is introduced, and an outlet through which refrigerant having passed through the tanks and the tubes is discharged. The inlet and the outlet are provided at side ends of the tanks in the width direction to be positioned at different-row tanks in the flow direction of air in such a manner that refrigerant Introduced from the inlet passes all refrigerant passages provided in one row where the inlet is positioned, passes through all refrigerant passages at adjacent row in order, and flows into the refrigerant outlet. In the evaporator, the lower tank portion has therein a throttle at which a refrigerant passage area is reduced. Thus, liquid refrigerant distribution in the tubes can be adjusted using the throttle, and temperature distribution of air blown out from the evaporator can be made uniform.

Preferably, the throttle includes plural throttle plates having throttle holes. Therefore, even when refrigerant distribution of the tubes in one row is ununiform, it is possible to offset the ununiform refrigerant distribution in a tube-overlapped portion in the flow direction of air, by suitably setting arrangement positions of the throttle plates, More preferably, adjacent tanks adjacent to each other in the flow direction of air are partitioned by a partition wall, and are provided to communicate with each other through communication holes provided in the partition wall. Therefore, the refrigerant distribution of the tubes can be finely set using both the throttle holes and the communication holes.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

A first preferred embodiment of the present invention will be described with reference to FIGS. 1–17. In the first embodiment, the present invention is typically applied to an evaporator 1 of a refrigerant cycle for a vehicle air conditioner. The evaporator 1 is disposed in a unit case of a vehicle air conditioner (not shown) to correspond to an arrangement in FIG. 1 in an up-down direction. When air is blown by a blower (not shown) and passes through the evaporator 1 in an air flowing direction A in FIG. 1, heat exchange is performed between blown-air and refrigerant flowing through the evaporator 1.

The evaporator 1 has plural tubes 2–5 through which refrigerant flows in a longitudinal direction of the tubes 2–5. The tubes 2–5 are arranged in parallel with each other in a width direction perpendicular to both of the air flowing direction A and the longitudinal direction of the tubes 2–5.

Figure 1:
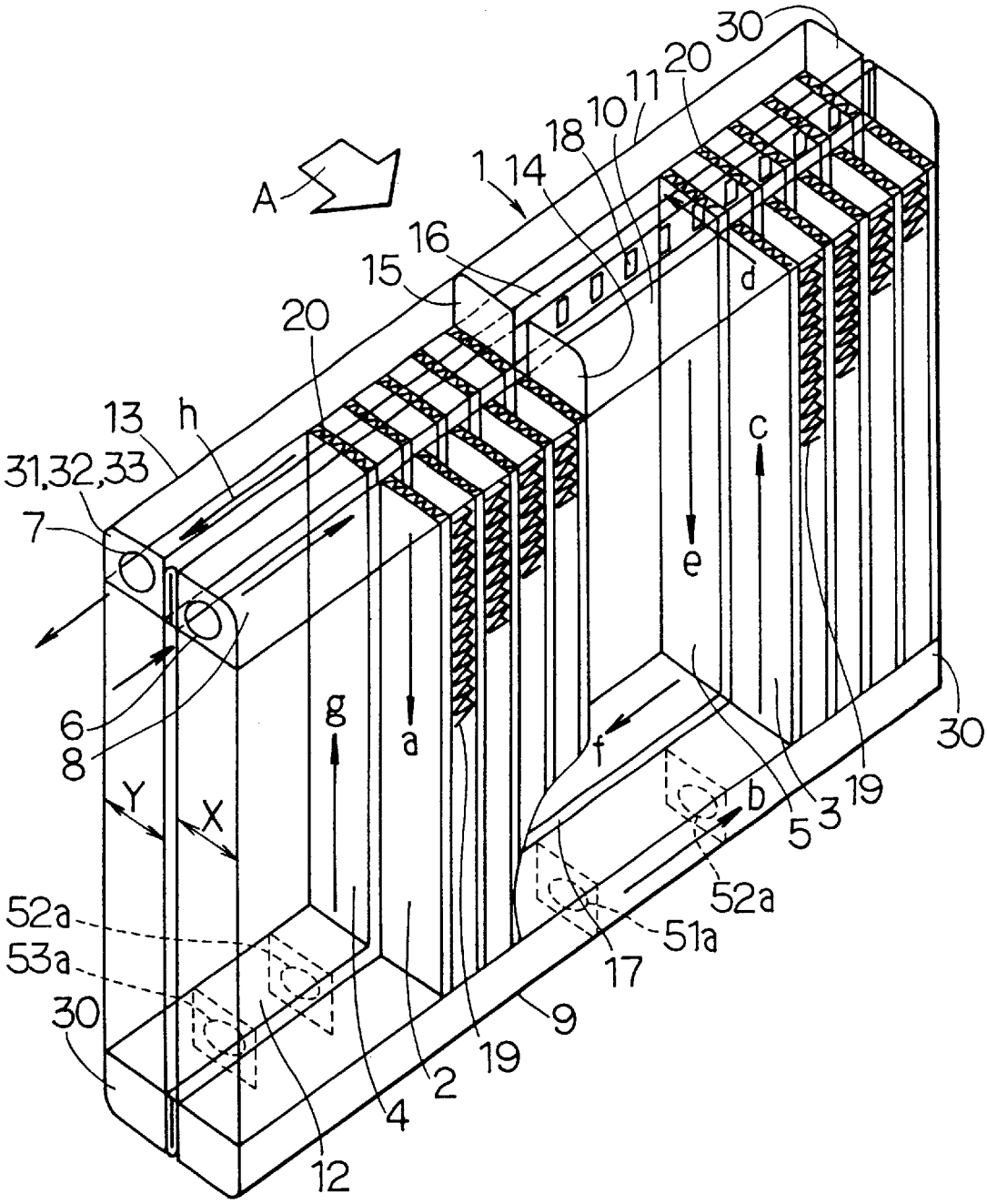
FIG. 1 is a schematic perspective view showing a refrigerant evaporator according to a first preferred embodiment of the present invention.

Further, the tubes 2–5 are arranged in two rows disposed adjacent to each other in the air flowing direction A. That is, the tubes 2, 3 are arranged at a downstream air side, and the tubes 4, 5 are arranged at an upstream air side of the tubes 2, 3. Each of the tubes 2–5 is a flat tube forming a refrigerant passage with a flat cross-section therein. The tubes 2, 3 form a refrigerant passage of an inlet-side heat exchange portion X, and the tubes 4, 5 form a refrigerant passage of an outlet-side heat exchange portion Y. In FIG. 1, the tubes 2 are disposed at a left side of the inlet-side heat exchange portion X, and the tubes 3 are disposed at a right side of the inlet-side heat exchange portion X. Similarly, the tubes 4 are disposed at a left side of the outlet-side heat exchange portion Y, and the tubes 5 are disposed at a right side of the outlet-side heat exchange portion Y.

The evaporator 1 has a refrigerant inlet 6 for introducing refrigerant and a refrigerant outlet 7 for discharging refrigerant. Low-temperature and low-pressure gas-liquid two-phase refrigerant decompressed by a thermal expansion valve (not shown) of the refrigerant cycle is introduced into the evaporator 1 through the inlet 6. The outlet 7 is connected to an inlet pipe of a compressor (not shown) of the refrigerant cycle so that gas refrigerant evaporated in the evaporator 1 is returned to the compressor through the outlet 7. In the first embodiment, the inlet 6 and the outlet 7 are disposed on an upper left end surface of the evaporator 1.

The evaporator 1 has an upper left inlet-side tank portion 8 disposed at an upper left inlet side, a lower inlet-side tank portion 9 disposed at a lower inlet side, an upper right inlet-side tank portion 10 disposed at an upper right inlet side, an upper right outlet-side tank portion 11 disposed in an upper right outlet side of the evaporator 1, a lower outlet-side tank portion 12 disposed at a lower outlet-side, and an upper left outlet-side tank portion 13 disposed at an upper left outlet side. The inlet 6 communicates with the upper left inlet-side tank portion 8, and the outlet 7 communicates with the upper left outlet-side tank portion 13.

Refrigerant is distributed from the tank portions 8–13 into the tubes 2–5 and is collected from the tubes 2–5 into the tank portions 8–13. The tank portions 8–13 are also arranged in two rows adjacent to each other in the air flowing direction A, corresponding to the arrangement of the tubes 2–5. That is, the inlet-side tank portions 8–10 are disposed at the downstream air side of the outlet-side tank portions 11–13.

The upper inlet-side tank portions 8, 10 are defined by a partition plate 14 disposed therebetween, and the upper outlet-side tank portions 11, 13 are defined by a partition plate 15 disposed therebetween. The lower inlet-side tank portion 9 and the lower outlet-side tank portion 12 are not partitioned, and extend along an entire width of the evaporator 1 in the width direction.

In the inlet-side heat exchange portion X of the evaporator 1, each upper end of the tubes 2 communicates with the upper left inlet-side tank portion 8, and each lower end of the tubes 2 communicates with the lower inlet-side tank portion 9. Similarly, each upper end of the tubes 3 communicates with the upper right inlet-side tank portion 10, and each lower end of the tubes 3 communicates with the lower inlet-side tank portion 9. In the outlet-side heat exchange portion Y of the evaporator 1, each upper end of the tubes 4 communicates with the upper left outlet-side tank portion 13, and each lower end of the tubes 4 communicates with the lower outlet-side tank portion 12. Similarly, each upper end of the tubes 5 communicates with the upper right outlet-side tank portion 11 and each lower end of the tubes 5 communicates with the lower outlet-side tank portion 12.

A partition wall 16 is formed between the upper left inlet-side tank portion 8 and the upper left outlet-side tank portion 13, and between the upper right inlet-side tank portion 10 and the upper right outlet-side tank portion 11. That is, the partition wall 16 extend in the entire width of the evaporator 1 in the width direction. A partition wall 17 is also formed between the lower inlet-side tank portion 9 and the lower outlet-side tank portion 12 to extend in the entire width of the evaporator 1 in the width direction. The partition walls 16, 17 are integrally formed with the tank portions 8–13, as described later.

In the first embodiment of the present invention, a right-side portion of the partition wall 16 partitioning the tank portions 10, 11 in FIG. 1 has plural communication holes 18 through which the tank portions 10, 11 communicate with each other. In the first embodiment, the communication holes 18 are formed to respectively correspond to the tubes 3, 5, so that refrigerant is uniformly distributed into the tubes 5. That is, the number of the communication holes 18 is the same as the number of the tubes 3, 5 in each row.

The communication holes 18 are simultaneously stamped in the partition wall 16 made of a metal thin plate (e.g., aluminum thin plate) through pressing or the like. In the first embodiment, each of the communication holes 18 is formed into a rectangular shape. Opening areas of the communication holes 18 and arrangement positions of the communication holes 18 are determined so that most appropriate distribution of refrigerant flowing into the tubes 3, 5 is obtained. In FIG. 1, the communication holes 18 are formed to have an uniform area. Therefore, the communication holes 18 are readily formed. However, the opening areas of the communication holes 18 and the shapes thereof may be arbitrarily changed.

Plural wave-shaped corrugated fins 19 are disposed between adjacent tubes 2–5, and are integrally connected to flat surfaces of the tubes 2–5. Further, plural wave-shaped inner fins 20 are disposed inside each of the tubes 2–5. Each wave peak portion of the inner fins 20 is bonded to each inner surface of the tubes 2–5. Due to the inner fins 20, the tubes 2–5 are reinforced and a heat conduction area for refrigerant is increased, thereby improving cooling performance of the evaporator 1.

Figure 2:
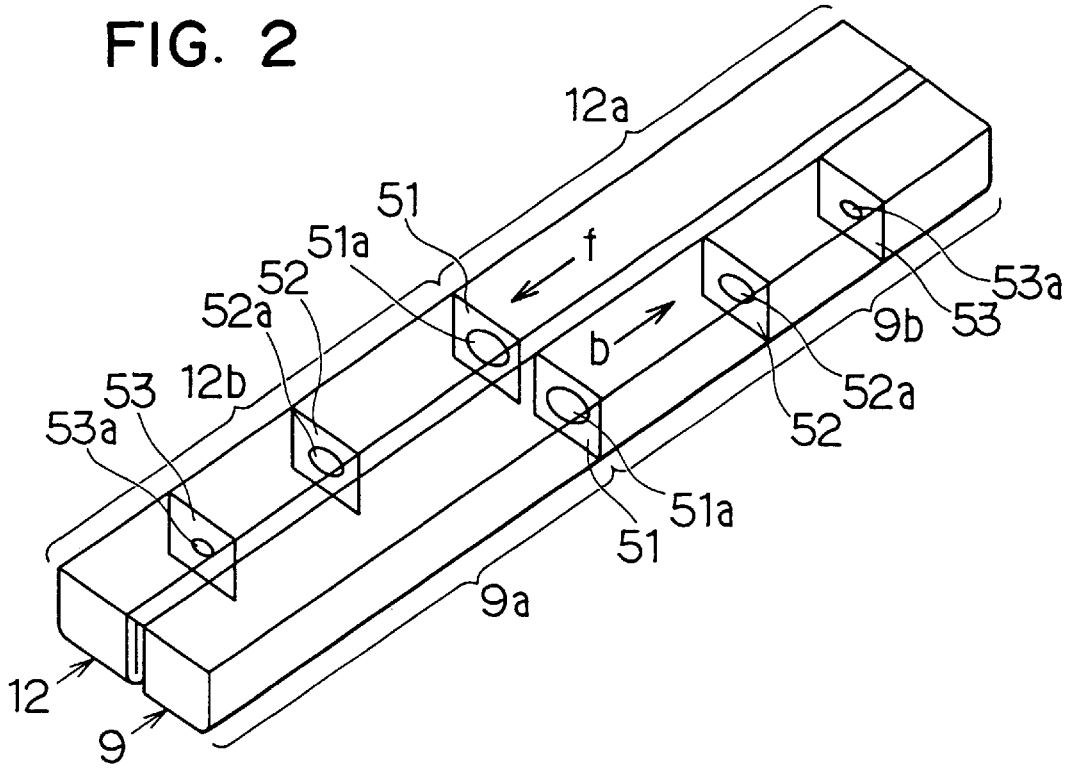
FIG. 2 is a schematic perspective view showing a lower tank portion of the evaporator according to the first embodiment.

FIG. 2 shows structure of the lower inlet-side tank portion 9 and the lower outlet-side tank portion 12 at the lower part of the tubes 2–5. Within the lower inlet-side tank portion 9, first, second and third throttle plates 51–53, which respectively have first, second and third throttle holes 51*a*–53*a* therein, are disposed so that liquid-refrigerant distribution for the tubes 3, 4 can be freely set. The first throttle plate 51 is disposed in the lower inlet-side tank portion 9 at the boundary between a collection tank 9*a* for collecting refrigerant from the tubes 2 and a distribution tank 9*b* for distributing refrigerant into the tubes 3. The second and third throttle plates 52, 53 are disposed to be spaced at predetermined intervals within the distribution tank 9*b* of the lower inlet-side tank portion 9.

Similarly, within the lower outlet-side tank portion 12, the first, second and third throttle plates 51–53 are also provided. The first throttle plate 51 is disposed at the boundary between a collection tank 12*a* for collecting refrigerant from the tubes 5 and a distribution tank 12*b* for distributing refrigerant into the tubes 4. The second and third throttle plates 52, 53 are disposed to be spaced at predetermined intervals within the distribution tank 12*b* of the lower outlet-side tank portion 12.

Each of the first to third throttle holes 51*a*–53*a* can be punched in a metal sheet (e.g., aluminum plate or the like), which constitutes the throttle plates 51–53 , by pressing. Each of the first to third throttle holes 51*a*–53*a* is formed into a circular shape as shown in FIG. 2. Opening areas of the first to third throttle holes 51*a*–53*a* are set so that the most appropriate distribution of refrigerant flowing into the tubes 3, 4 is obtained. In the first embodiment, the opening areas of the throttle holes 51*a*–53*a* are set to become smaller along toward a downstream side of a refrigerant flow. In the first embodiment, the number of the throttle plates 51–53 and the shape of the throttle holes 51*a*–53*a* may be changed. The throttle plates 51–53 are integrally bonded to the tank portions 9, 12 by brazing, after being formed separately from the tank portions 9, 12, as described later. In the first embodiment, the evaporator 1 is assembled by integrally connecting each of parts through brazing.

Next, operation of the evaporator 1 according to the first embodiment of the present invention will be described. As shown in FIG. 1, first, low-temperature and low-pressure gas-liquid two-phased refrigerant decompressed by the expansion valve (not shown) of the refrigerant cycle is introduced into the upper left inlet-side tank portion 8 from the inlet 6, and is distributed into the tubes 2 to flow downwardly through the tubes 2 as shown by arrow "a". Then, refrigerant flows through the lower inlet-side tank portion 9 rightwardly as shown by arrow "b", and is distributed into the tubes 3 to flow upwardly through the tubes 3 as shown by arrow "c". Refrigerant flows into the upper right inlet-side tank portion 10, passes through the communication holes 18 as shown by arrow "d", and flows into the upper right outlet-side tank portion 11. Thus, refrigerant moves from the downstream air side to the upstream air side through the communication holes 18. Thereafter, refrigerant is distributed into the tubes 5 from the upper right outlet-side tank portion 11, flows downwardly through the tubes 5 as shown by arrow "e", and flows into a right-side portion of the lower outlet-side tank portion 12.

Further, refrigerant flows leftwardly as shown by arrow "f" through the lower outlet-side tank portion 12, is distributed into the tubes 4, and flow upwardly through the tubes 4 as shown by arrow "g". Thereafter, refrigerant is collected into the upper left outlet-side tank portion 13, flows leftwardly as shown by arrow "h" through the tank portion 13, and is discharged from the outlet 7 to the outside of the evaporator 1.

On the other hand, air is blown in the air flowing direction A toward the evaporator 1 and passes through openings of the heat exchange portions X, Y of the evaporator 1. At this time, refrigerant flowing through the tubes 2–5 absorbs heat from air and is evaporated. As a result, air passing through the evaporator 1 is cooled, and is blown into a passenger compartment of the vehicle to cool the passenger compartment.

According to the first embodiment, the inlet-side heat exchange portion X including a zigzag-routed inlet-side refrigerant passage indicated by arrows "a"–"c" in FIG. 1 is disposed on the downstream air side of the outlet-side heat exchange portion Y including a zigzag-routed outlet-side refrigerant passage indicated by arrows "e"–"h" in FIG. 1. Therefore, the evaporator 1 can effectively perform heat exchange with excellent heat conductivity.

Further, the upper right inlet-side tank portion 10 and the upper right outlet-side tank portion 11 disposed on the upstream air side of the tank portion 10 directly communicate with each other through the communication holes 18 formed in the partition wall 16 disposed therebetween. Therefore, the inlet-side refrigerant passage of the evaporator 1 communicates with the outlet-side refrigerant passage of the evaporator 1 without any additional refrigerant passage such as a side passage. Thus, the structure of the evaporator 1 is simplified and pressure loss of refrigerant flowing through the evaporator 1 is decreased. As a result, evaporation pressure and evaporation temperature of refrigerant in the evaporator 1 is decreased, thereby improving cooling performance of the evaporator 1.

In the evaporator 1, the refrigerant passages are provided, so that refrigerant from the refrigerant inlet 6 passes through the heat exchange portion Y and is charged from the refrigerant outlet 7 after passing through all the heat exchange portion X. Therefore, the refrigerant inlet 6 and the refrigerant outlet 7 can be collectively located at one end side (e.g., left upper end side in FIG. 1) of the heat exchange portions X, Y in the width direction perpendicular to the air flowing direction A. Therefore, an outside pipe outside an air conditioner case (not shown) can be directly connected to the refrigerant inlet 6 and the refrigerant outlet 7 by providing an opening in the air conditioner case at positions corresponding to the refrigerant inlet 6 and the refrigerant outlet 7. Thus, an assistant pipe for connection becomes unnecessary.

In the evaporator 1 of the first embodiment, distribution of the refrigerant flowing through each of the tubes 2–5 is set as described later, for obtaining a uniform temperature distribution of air blown out from the evaporator 1.

First, a refrigerant distribution within the tubes 2, 4 arranged to be overlapped in the air flowing direction A will be now described. When the refrigerant is distributed from the upper inlet-side tank portion 8 into the tubes 2, much of the liquid refrigerant generally readily flows into the tubes 2 proximate to the inlet 6 (the left side in FIG. 1) by gravity.

On the other hand, the liquid refrigerant is difficult to flow into the tubes 2 at the side opposite the inlet 6. However, refrigerant before an heat exchange with air flows into the upper inlet-side tank portion 8. Therefore, a liquid refrigerant ratio becomes high, and a sufficient amount of liquid refrigerant flows into the tubes 2 at the side opposite the inlet 6 (i.e., the right side in FIG. 1). As a result, the distribution of the liquid refrigerant into the tubes 2 is relatively uniform.

On the other hand, a liquid refrigerant distribution within the tubes 4 located at the direct upstream air side of the tubes 2 is made approximately uniform by providing the throttle plates 51–53 having the throttle holes 51*a*–53*a* within the distribution tank 12*b*.

When the throttle holes 51*a*–53*a* are not provided in the distribution tank 12*b*, liquid refrigerant mainly flows into the leftmost side of the distribution tank 12*b* by the inertial force of liquid refrigerant. Therefore, liquid refrigerant mainly flows into the left side of the tubes 4, and gas refrigerant mainly flows into the right side of the tubes 4, so that distribution of liquid refrigerant becomes ununiform in the tubes 4. However, according to the first embodiment of the present invention, refrigerant flowing through the tank portion 12 in the direction as shown by the arrow "f" is speeded in flowing when passing through the first throttle hole 51*a*. At a position immediately after refrigerant passes through the first throttle hole 51*a*, the gas refrigerant and the liquid refrigerant are mixed, so that the mixed refrigerant flows into the tubes 4 provided at the portion immediately after the first throttle hole 51*a*. Liquid refrigerant flowing from the throttle hole 51*a* to a further left side is restricted by the second throttle plate 52. Therefore, the amount of liquid refrigerant flowing into the tubes 4 at the portion just before the second throttle plate 52 is increased.

At the portion immediately after the second throttle hole 52*a*, gas refrigerant and liquid refrigerant are mixed, so that the mixed gas-liquid refrigerant flows into the tubes 4 provided at the portion immediately after the second throttle hole 52*a*. Similarly, the amount of liquid refrigerant flowing into the tubes 4 at a portion just before the third throttle plate 53 is increased by restriction operation of the third throttle plate 53 , and the gas-liquid two-phase refrigerant flows into the tubes 4 provided at a portion immediately after the third throttle hole 53*a* by the mixing operation of the third throttle plate 53.

The distribution of liquid refrigerant can be set approximately uniformly by suitably setting the opening areas of the first to third throttle holes 51*a*–53*a* and the arrangement positions of the first to third throttle plates 51–53. Therefore, temperature distribution of air, passing through the tubes 2, 4 arranged at downstream and upstream air sides in the air flowing direction A, can be made uniform. On the other hand, by suitably setting the opening areas of the first to third throttle holes 51*a*–53*a* and the arrangement positions of the first to third throttle plates 51–53 , it is possible to set the distribution of liquid refrigerant in the tubes 4 in accordance with the distribution of liquid refrigerant in the tubes 2, so that air blown from the overlapped tubes 2, 4 has a uniform temperature distribution.

Figure 3:
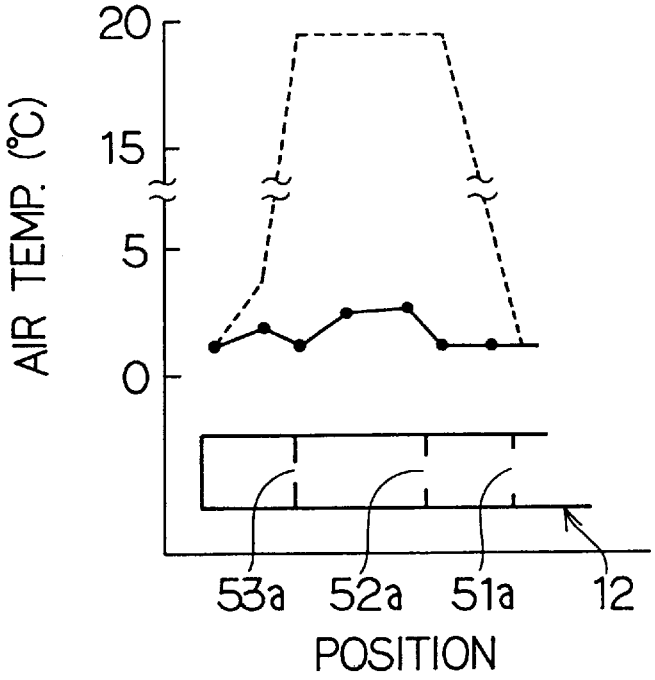
FIG. 3 is a graph showing temperature distribution of air blown from the evaporator.

When air having temperature 27° C. is blown into only a single refrigerant-outlet side heat exchange portion Y with the first to third throttle holes 51*a*–53*a*, temperature distribution of air blown out from the tubes 4 at different positions is shown by the solid line in FIG. 3. When air having temperature 27° C. is blown into only the single refrigerant-outlet side heat exchange portion Y without the throttle holes 51*a*–53*a*, temperature distribution of the air blown out from the tubes 4 at different positions is shown by the chain line in FIG. 3. As shown in FIG. 3, temperature distribution of blown-air is greatly improved to be made approximately uniform due to the throttle holes 51*a*–53*a*.

Further, the whole area of the heat exchange portions X, Y is effectively used by uniformly distributing liquid refrigerant into the tubes 2–5, thereby improving heat-exchange efficiency. While the refrigerant flows from the tubes 4 into the tank 13, gasification of the refrigerant can be just completed readily by uniformly distributing liquid refrigerant into the tubes 4.

Here, the first throttle plate 51 is disposed at the boundary between collection tank 9*a* for collecting refrigerant and the distribution tank 9*b* for distributing refrigerant.

Further, the first throttle plate 51 is also disposed at the boundary between the collection tank 12*a* and the distribution tank 12*b*. In the first embodiment, the first throttle plate 51 can be disposed at a position proximate to the boundary. Even in this case, the same effect as that of the first embodiment can be obtained.

Next, refrigerant distribution in the tubes 3, 5 located at downstream and upstream sides in the air flowing direction A will be described. That is, the tubes 3, 5 are overlapped in the air flowing direction A. The first to third throttle plates 51–53 having the throttle holes 51*a*–53*a* are disposed in the distribution tank 9*b* to uniformly distribute liquid refrigerant in the tubes 3, similarly to the first to third throttle holes 51*a*–53*a* provided in the distribution tank 12*b* described above. With the uniform distribution of the liquid refrigerant within the tubes 3, the refrigerant distribution within the tubes 5 can be made uniform because the plural communication holes 18 having the same opening areas are provided at equal intervals in the width direction perpendicular to the air flowing direction A. Accordingly, it is possible to propose a uniform temperature distribute of air blown from the overlapped tubes 3, 5.

When the ununiform distribution of liquid refrigerant within the tubes 2 becomes larger, the distribution of liquid refrigerant within the tubes 4 is made opposite to that within the tubes 2 by suitably setting the opening areas of the first to third throttle holes 51*a*–53*a* in the distribution tank 12*b* and the arrangement positions of the first to third throttle plates 51–53 therein. Therefore, even in this case, temperature distribution of air passing through the tubes 2, 4 can be made uniform.

When an ununiform distribution of liquid refrigerant within the tubes 3 is caused, refrigerant distribution within the tubes 5 is adjusted by suitably setting the opening area and the arrangement positions of the plural communication holes 18, so that the temperature distribution of air blown out from the tubes 3, 5 is made uniform.

In the first embodiment of the present embodiment, refrigerant passages of the tubes 2 having a relatively larger ratio of liquid refrigerant at the side of the refrigerant inlet 6 and refrigerant passages of the tubes 4 have a relatively larger ratio of gas refrigerant at the side of the refrigerant outlet 7 are disposed in series in the air flowing direction A. Therefore, even if the flow amount of refrigerant is smaller, temperature distribution of air blown out from the evaporator 1 can be made uniform.

Further, according to the first embodiment of the present embodiment, the liquid-refrigerant distribution in each of the tubes 2–5 can be individually adjusted by the throttle holes 51*a*–53*a* and the communication holes 18. Therefore, elaborate adjustment is not necessary by providing plural throttle holes at predetermined positions, while pressure loss within the refrigerant passages is suppressed.

Next, the structure of the evaporator 1 and a manufacturing method thereof according to the first embodiment will be described.

Figure 4:
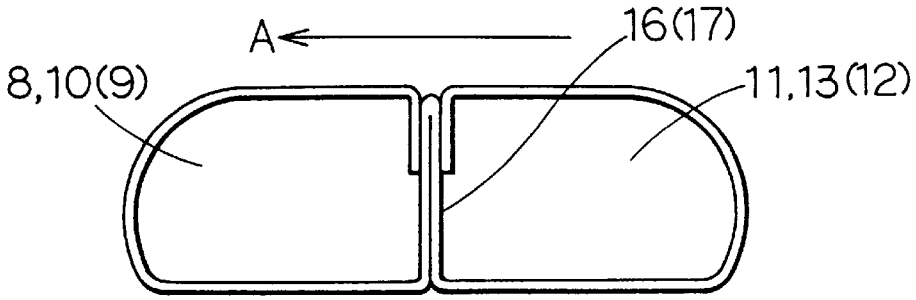
FIG. 4 is a schematic sectional view showing an end surface of tank portions according to the first embodiment.

As shown in FIG. 4, the upper tank portions 8, 10, 11, 13 or the lower tank portions 9, 12 are formed by bending an aluminum thin plate. That is, the upper tank portions 8, 10, 11, 13 and partition wall 16 are integrally formed by bending a single aluminum thin plate. A center folded portion of the aluminum thin plate forms the partition wall 16. Similarly, the lower tank portions 9, 12 and the partition wall 17 are integrally formed by bending a single aluminum thin plate. The tank portions 8–13 are applied with relatively large stress by refrigerant pressure in comparison with the tubes 2–5. Therefore, for example, a thickness of the aluminum thin plate for forming the tank portions 8–13 is 0.6 mm so that the tank portions 8–13 have sufficient strength.

Each aluminum thin plate for forming the tank portions 8–13 is a one-side clad aluminum plate, i.e., an aluminum core plate (A3000) clad with brazing material (A4000) on only one side surface thereof, for example. The one-side clad aluminum plate is disposed so that the surface clad with brazing material is disposed inside the tank portions 8–13 and the core plate is exposed outside. Sacrifice corrosion material (e.g., Al-1.5 wt %Zn) may be applied to an outer surface of the core plate so that the core plate is sandwiched between brazing material and sacrifice corrosion material. As a result, anticorrosion performance of the one-side clad aluminum plate is improved.

Figure 5A:
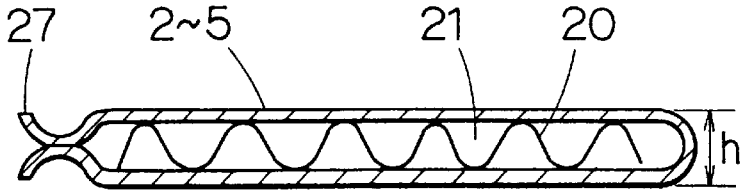
FIG. 5A is a cross-sectional view showing a tube according to the first embodiment.

Referring to FIG. 5A, a single aluminum thin plate is bent so that an inner refrigerant passage 21 having a flat-shaped cross section is formed in each of the tubes 2–5. The inner refrigerant passage 21 is partitioned into plural small passages by the inner fins 20. The inner surfaces of the tubes 2–5 and each of the wave peak portions of the inner fins 20 are bonded so that the plural small passages extending in the longitudinal direction of the tubes 2–5 are partitioned in the inner refrigerant passage 21.

Figure 5B:
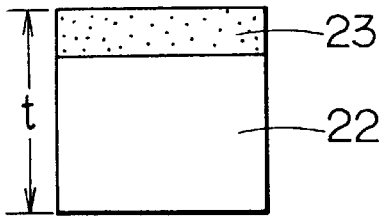
FIG. 5B is a view for explaining a tube forming material according to the first embodiment.

As shown in FIG. 5B, the aluminum thin plate for forming the tubes 2–5 may be an aluminum bare plate, i.e., an aluminum core plate 22 (A3000) applied with sacrifice corrosion material 23 (e.g., Al-1.5 wt %Zn) on one side surface thereof, so that the surface applied with the sacrifice corrosion material 23 is disposed outside the tubes 2–5. Since the tubes 2–5 are reinforced by the inner fins 20, thickness "t" of the aluminum thin plate for forming the tubes 2–5 can be decreased to approximately 0.25–0.4 mm. Therefore, a height "h" of each of the tubes 2–5 can be decreased to approximately 1.75 mm in the width direction. The inner fins 20 are also made of an aluminum bare plate (A3000).

Figure 5C:
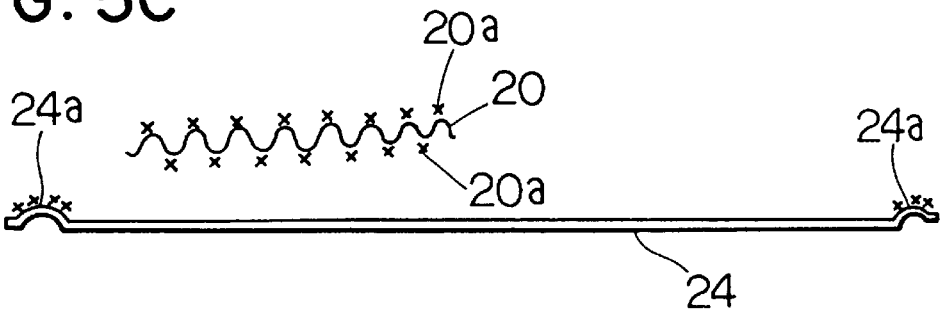
FIG. 5C is a view for explaining an applying state of a brazing material onto a tube-forming member according to the first embodiment.

As shown in FIG. 5C, brazing material (A4000) is applied to connection points on the tubes 2–5 and the inner fins 20, for connection between each of the tubes 2–5 and the inner fins 20. That is, before bending an aluminum thin plate 24 for forming the tubes 2–5 (hereinafter referred to as tube thin plate 24), paste brazing material 24*a* (A4000) is applied to an inner surface of both lateral end portions of the tube thin plate 24. Similarly, before attaching the inner fin 20 to an inner surface of each of the tubes 2–5, paste brazing material 20*a* (A4000) is applied to each of the wave peak portions of the inner fin 20. Therefore, connection between the lateral end portions of the tube thin plate 24 and connection between the inner surface of the tube thin plate 24 and the inner fin 20 can be simultaneously performed when the evaporator 1 is integrally brazed. When the tube thin plate 24 is an one-side clad aluminum plate clad with brazing material on one side surface thereof to be disposed inside the tubes 2–5, brazing material does not need to be applied to the tube thin plate 24. Further, each of the inner fins 20 may be made of a both-side clad aluminum plate clad with brazing material on both side surfaces thereof. In this case, application of brazing material to the wave peak portions of the inner fin 20 is not needed.

Figure 6:
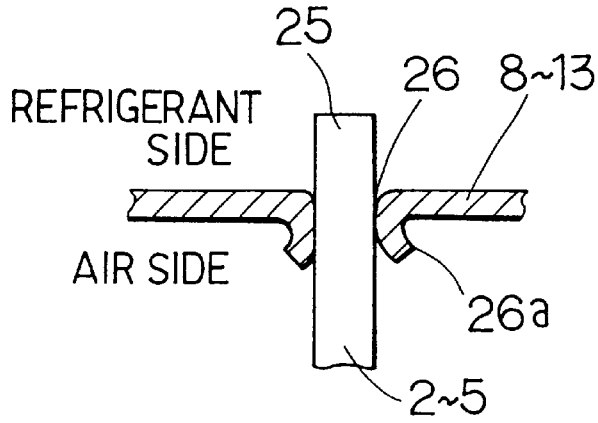
FIG. 6 is a cross-sectional view showing an insertion structure of the tube into the tank portions according to the first embodiment.
Figure 7C:
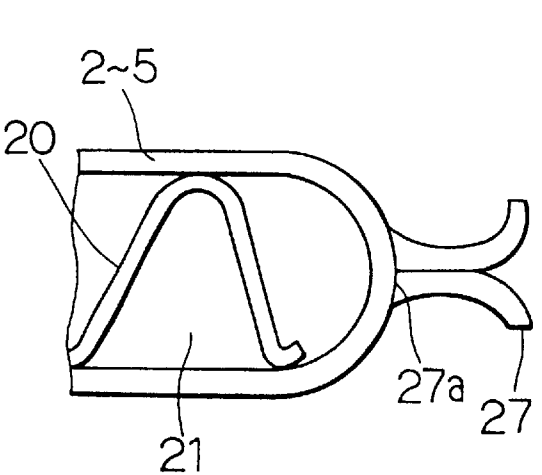
FIG. 7C is an enlarged partial view of FIG. 7B.
Figure 7A:
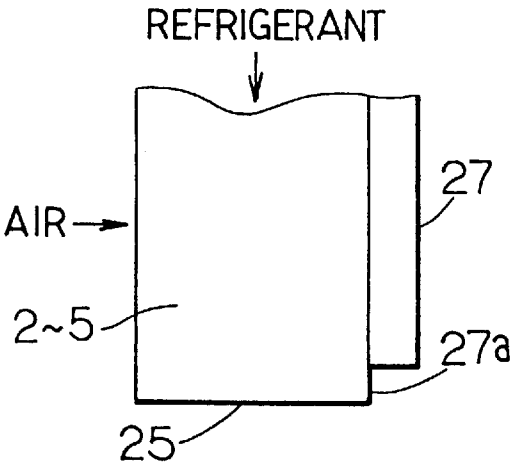
FIG. 7A is a plan view -showing a longitudinal end portion of the tube according to the first embodiment.
Figure 7E:
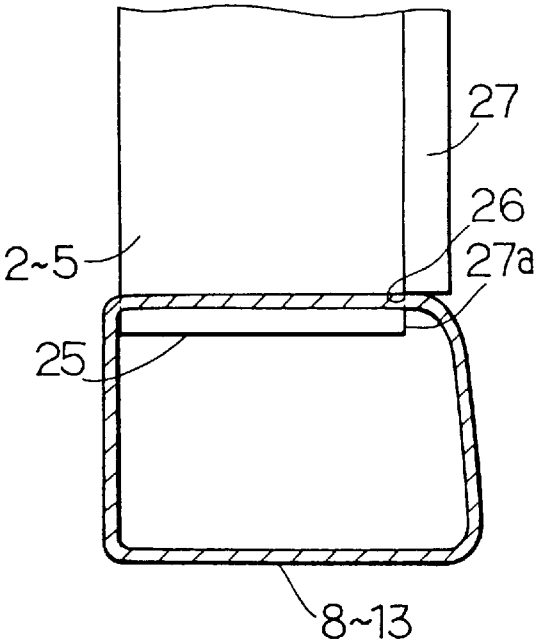
FIG. 7E is a schematic view showing an insertion state of the longitudinal end portion of the tube into the tank portion according to the first embodiment.
Figure 7D:
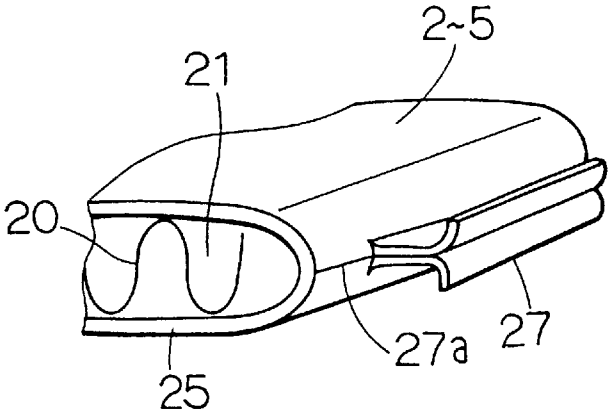
FIG. 7D is an enlarged perspective view showing the longitudinal end portion of the tube according to the first embodiment.
Figure 7B:
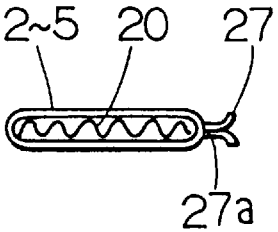
FIG. 7B is a front view showing the longitudinal end portion of the tube according to the first embodiment.

As shown in FIG. 6, in the first embodiment, each of end portions 25 of the tubes 2–5 in the longitudinal direction is connected to the tank portions 8–13 by inserting the end portions 25 into tube insertion holes 26 formed in each flat surface of the tank portions 8–13. In order to facilitate insertion of the tubes 2–5 into the tank portions 8–13, each of the end portions 25 is formed as shown in FIG. 7A. That is, as shown in FIGS. 5A, 7A, each of the tubes 2–5 has an end enlarged portion 27 at which the lateral end portions of the tube thin plate 24 are connected with each other. As shown in FIG. 7A, the end enlarged portion 27 is cut off at both longitudinal ends of each of the tubes 2–5, thereby forming a recess portion 27*a*. That is, each end portion 25 of tubes 2–5 does not have the end enlarged portion 27. As a result, each of the longitudinal end portions 25 has a substantially oval cross-section. As shown in FIG. 7E, the recess portion 27*a* is used as a positioning stopper for each of the tubes 2–5 when the end portion 25 is inserted into the tube insertion hole 26. As a result, insertion of the tubes 2–5 into the tank portions 8–13 is facilitated. FIG. 7E shows only one of the downstream air side and the upstream air side of the tank portions 8–13 and the tubes 2–5 for brevity.

Each tube insertion hole 26 is formed into an oval shape corresponding to a cross-sectional shape of each end portion 25 of the tubes 2–5. Each of the tube insertion holes 26 has a projecting portion 26*a* formed to a project outside the tank portions 8–13 along a circumference of the tube insertion hole 26. As shown in FIG. 6, when each of the end portions 25 of the tubes 2–5 is inserted into the tube insertion holes 26, inner surfaces of the projecting portions 26*a* of the tank portions 8–13 contacts each of the end portions 25. Therefore, the tank portions 8–13 and the tubes 2–5 can be connected with each other through brazing material applies on the inner surfaces of the tank portions 8–13.

Figure 8:
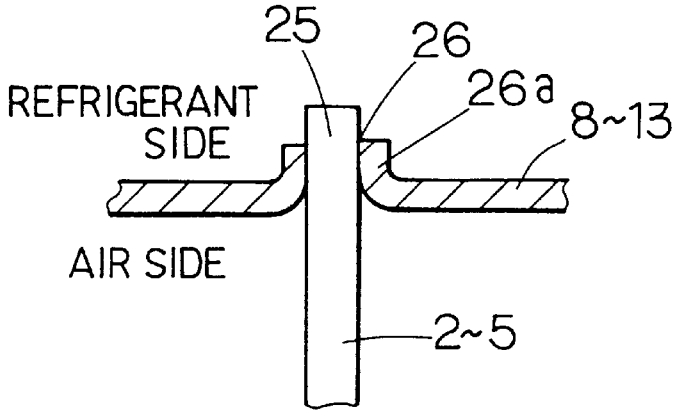
FIG. 8 is a sectional view showing a connection structure between the tube and the tank portions according to a modification of the first embodiment.

As shown in FIG. 8, the projecting portions 26a may project inside the tank portions 8–13. In this case, brazing material may be applied to each of the end portions 25 of the tubes 2–5 before inserting the tubes 2–5 into the tank portions 8–13. Therefore, the tank portions 8–13 and the tubes 2–5 can be brazed with each other through brazing material applied onto each of the end portions 25.

Figure 9:
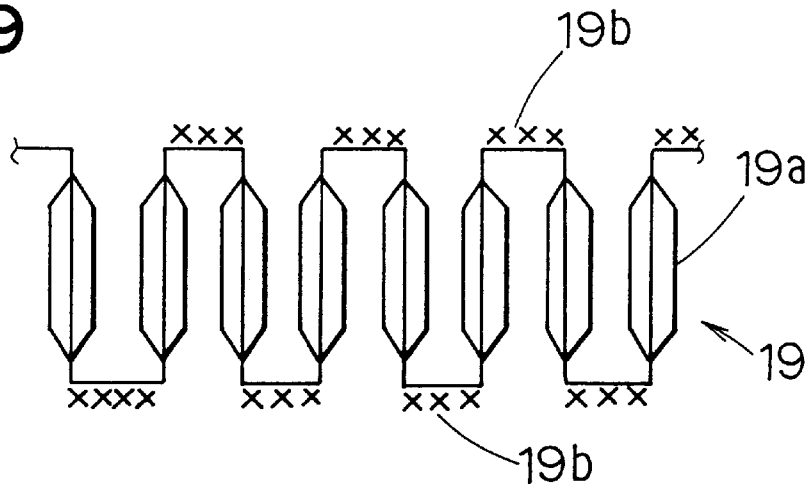
FIG. 9 is a schematic view for explaining an applying state of brazing material onto corrugated fins of the evaporator according to the first embodiment.

As shown in FIG. 9, the corrugated fin 19 has well known louvers 19*a* formed by cutting and standing slantingly a part of the corrugated fin 19. The corrugated fin 19 is made of an aluminum bare plate (A3000). Therefore, after brazing material 19*b* is applied to each of wave peak portions of the corrugated fin 19, the corrugated fin 19 is connected to the tubes 2–5 at the wave peak portions through the brazing material 19*b*.

Figure 10:
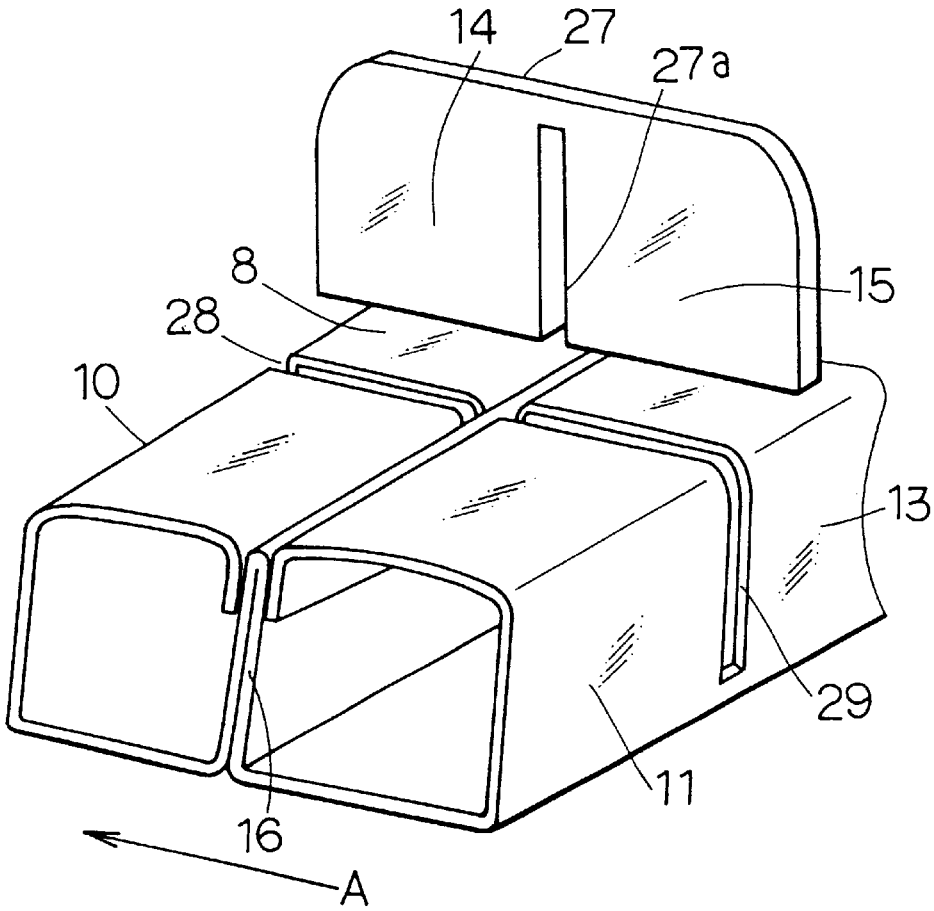
FIG. 10 is an enlarged perspective view showing a disassemble state of partition plates and the tank portions according to the first embodiment.

As shown in FIG. 10, the partition plates 14, 15 are integrally formed using a single plate member 27 so that attachment of the partition plates 14, 15 to the tank portions 8, 10, 11 and 13 is facilitated. The plate member 27 forming the partition plates 14, 15 is made of a both-side clad aluminum plate, i.e., an aluminum core plate (A3000) clad with brazing material (A4000) on both side surfaces thereof, for example.

The plate member 27 has a slit groove 27*a* engaged with the partition wall 16 disposed between the tank portion 8 and the tank portion 13 and between the tank portion 10 and the tank portion 11. A slit groove 28 into which the partition plate 14 is inserted is formed between the tank portion 8 and the tank portion 10, and a slit groove 29 into which the partition plate 15 is inserted is formed between the tank portion 11 and the tank portion 13. The partition plates 14, are respectively inserted into the slit grooves 28, 29 while the slit groove 27*a* is engaged with the partition wall 16.

Therefore, the partition plates 14, 15 are connected to the tank portions 8, 10, 11 and 13 using brazing material applied on the both side surfaces of the plate member 27 and brazing material applied on the inner surfaces of the tank portions 8, 10, 11 and 13. Thus, the tank portion 8 and the tank portion 10 are partitioned from each other, and the tank portion 11 and the tank portion 13 are partitioned from each other. The partition plates 14, 15 may be separately formed.

Figure 11:
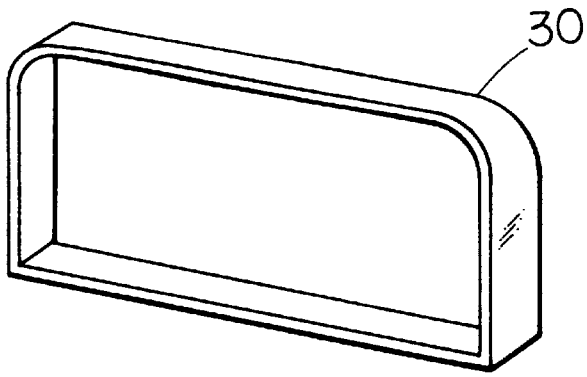
FIG. 11 is a perspective view showing a lip portion for the tank portions according to the first embodiment.

FIG. 11 shows a lid portion 30 for the tank portions 8–5 13. As shown in FIG. 1, the tank portions 8–13 have four longitudinal end openings, that is, upper-right end opening, upper-left end opening, lower-right end opening and lower-left end opening. The lid portion 30 is attached to each of the three end openings, except for the upper-left end opening at which the inlet 6 and outlet 7 are provided. The lid portion 30 is formed into a bowl-like shape by pressing using an one-side clad aluminum plate clad with brazing material on one side surface thereof. The surface clad with brazing material is set to an inner surface of the lid portion 30. The inner surface of the lid portion 30 is engaged with and connected to an outer surface of each of the three longitudinal end portions of the tank portions 8–13 through brazing material applied on the inner surface of the lid portion 30. Thus, the three longitudinal end openings of the tank portions 8–13 except for the upper left end opening where the inlet 6 and the outlet 7 are formed, are closed.

Figure 12:
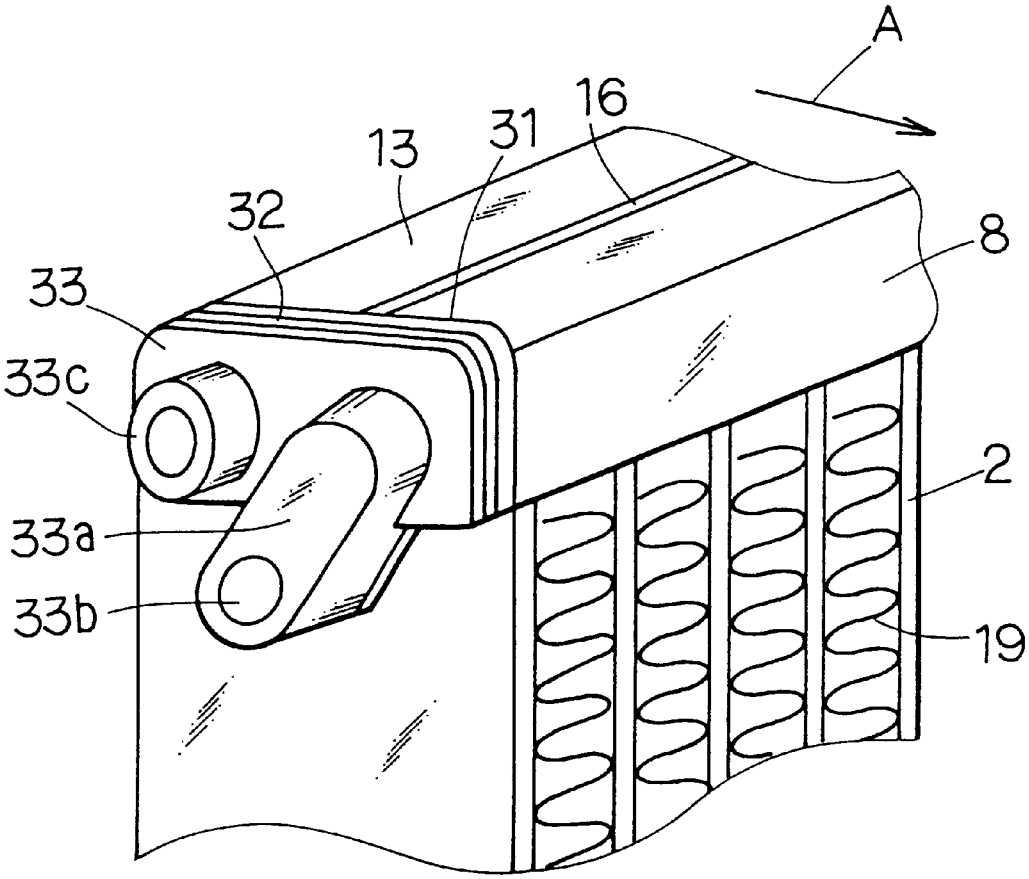
FIG. 12 is a perspective view showing a pipe joint portion of the evaporator according to the first embodiment.
Figure 13:
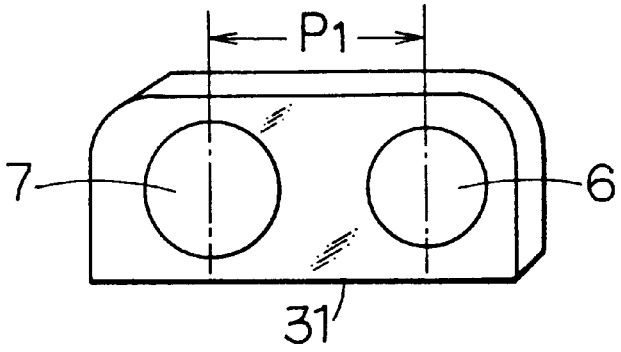
FIG. 13 is a perspective view showing a lip portion to which the pipe joint portion is attached according to the first embodiment.

Next, a pipe joint portion of the evaporator 1 will be described with reference to FIGS. 12–14C. The pipe joint portion is disposed at the upper-left end opening of the tank portions 8,13. As shown in FIG. 12, the pipe joint portion includes a lid portion 31, an intermediate plate member 32 and a joint cover 33. As shown in FIG. 13, the lid portion 31 is formed by pressing using a both-side clad aluminum plate clad with brazing material on both side surfaces thereof, and is connected to the upper-left end portion of the tank portions 8, 13. The lid portion 31 includes the inlet 6 communicating with the tank portion 8 and the outlet 7 communicating with the tank portion 13.

Figure 14A:
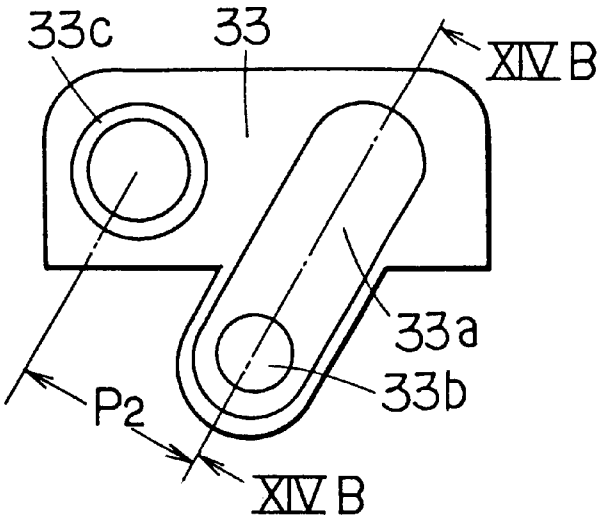
FIG. 14A is a front view showing the pipe joint portion according to the first embodiment.
Figure 14B:
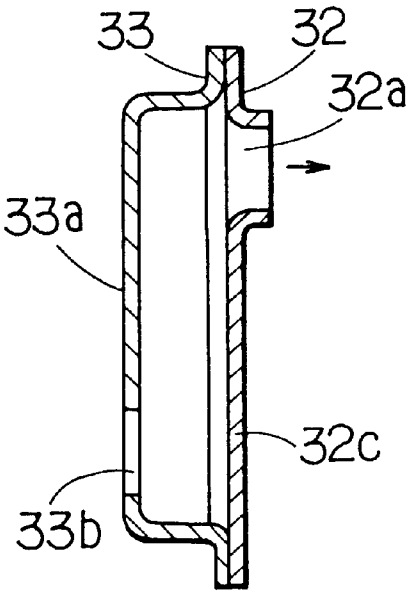
FIG. 14B is a cross-sectional view taken along line XIVB-XIVB in FIG. 14A.
Figure 14C:
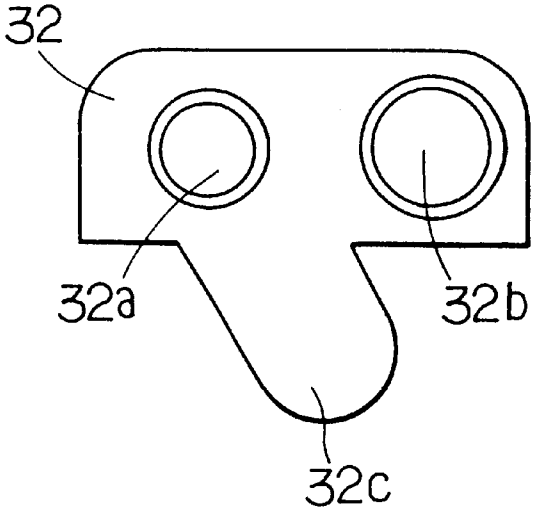
FIG. 14C is a front view showing an intermediate plate member of the pipe joint portion according to the first embodiment.

As shown in FIG. 14C, the intermediate plate member 32 has an inlet-side opening 32*a* communicating with the inlet 6, an outlet-side opening 32*b* communicating with the outlet 7 and a protruding portion 32*c* protruding from a position adjacent the inlet-side opening 32*a* obliquely. The intermediate plate member 32 is made of an aluminum bare plate (A3000) on which the brazing material is not clad.

The joint cover 33 is made of an one-side clad aluminum plate clad with brazing material on one side surface thereof. The joint cover 33 is connected to the intermediate plate member 32 so that the surface clad with brazing material of joint cover 33 faces the intermediate plate member 32. The joint cover 33 has a passage forming portion 33*a,* a connection opening 33*b* formed at an end of the passage forming portion 33*a,* and a cylindrical portion 33*c*. The passage forming portion 33*a* is formed into a semi-cylindrical shape, and covers the intermediate plate member 32 from the inlet-side opening 32*a* to a protruding end portion of the protruding portion 32*c*. The cylindrical portion 33*c* is formed to protrude from a surface of the joint cover 33, and communicates with the outlet-side opening 32*b* of the intermediate plate member 32. The connection opening 33*b* of the joint cover 33 is connected to an outlet of the expansion valve, and the cylindrical portion 33*c* thereof is connected to an inlet of a gas refrigerant temperature detecting portion of the expansion valve.

The pipe joint portion is formed by integrally brazing the lid portion 31, the intermediate plate member 32 and the joint cover 33. Accordingly, referring to FIGS. 13, 14A, even when a pipe pitch P2 between an inlet and an outlet of the expansion valve is smaller than a pipe pitch P1 between the inlet 6 and the outlet 7, difference therebetween can be absorbed by the pipe joint portion.

Figure 15A:
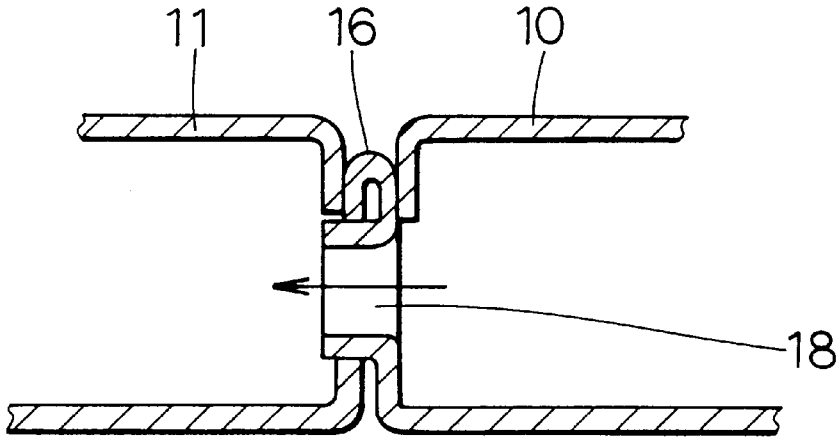
FIGS. 15A–15C are cross-sectional views showing communication holes according to the first embodiment.
Figure 15B:
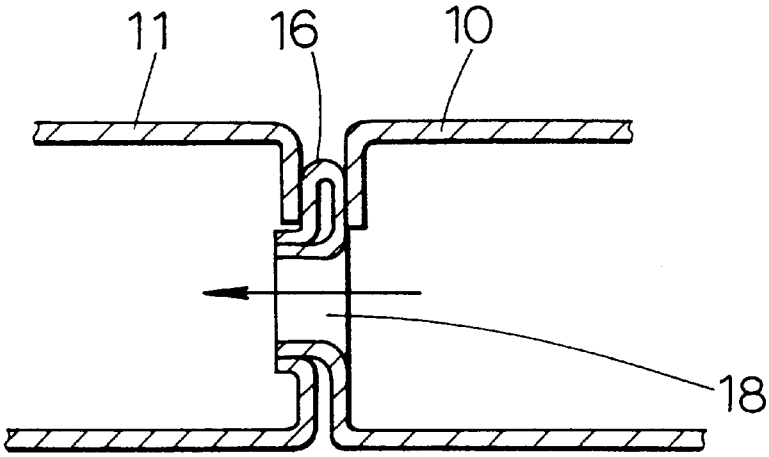
Figure 15C:
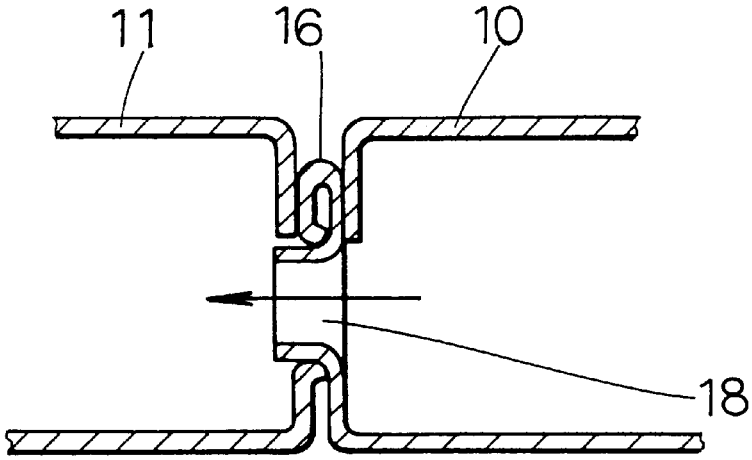

FIGS. 15A–15C show three examples of the communication hole 18. In FIGS. 15A–15C, the communication hole 18 is formed in the partition wall 16 (i.e., a center folded portion) between the tank portions 10, 11 to have a projecting portion along its circumference.

Figure 16A:
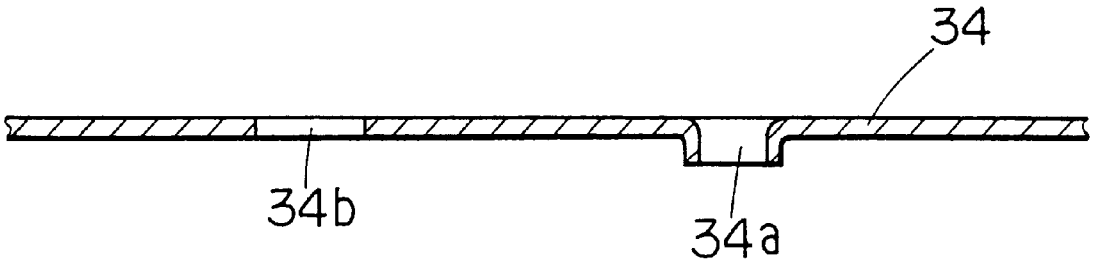
FIGS. 16A–16D are schematic sectional views showing a method forming the communication hole according to the first embodiment.
Figure 16B:
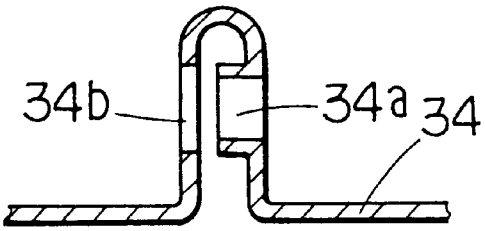
Figure 16C:
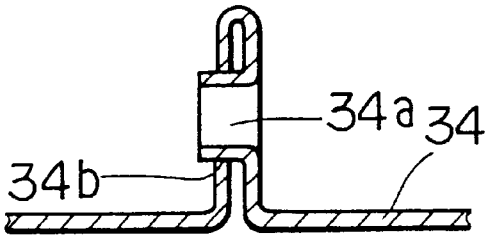
Figure 16D:
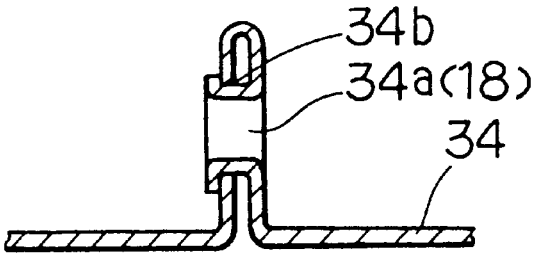

A method of forming the communication hole 18 will be described with reference to FIGS. 16A–146. First, as shown in FIG. 16A, a flue hole 34*a* with a projecting portion and a stamped hole 34*b* without a projecting portion are formed by pressing in an aluminum thin plate 34 forming the tank portions 8, 10, 11 and 13 (hereinafter the aluminum thin plate 34 is referred to as tank thin plate 34). The stamped hole 34*b* has a suitable diameter so that the projecting portion of the flue hole 34*a* can be inserted into the stamped hole 34*b*. Next, as shown in FIG. 16B, the tank thin plate 34 is bent to have a U-shape so that the flue hole 34*a* faces the stamped hole 34*b*. Then, as shown in FIG. 16C, the projecting portion of flue hole 34*a* is inserted into the stamped hole 34*b*. Further, as shown in FIG. 16D, an end portion of the projecting portion is bent toward an outer circumferential side for clamping. As a result, the projecting portion of the flue hole 34*a* is restricted from releasing from the stamped hole 34*b,* and the communication hole 18 is formed.

Figure 17:
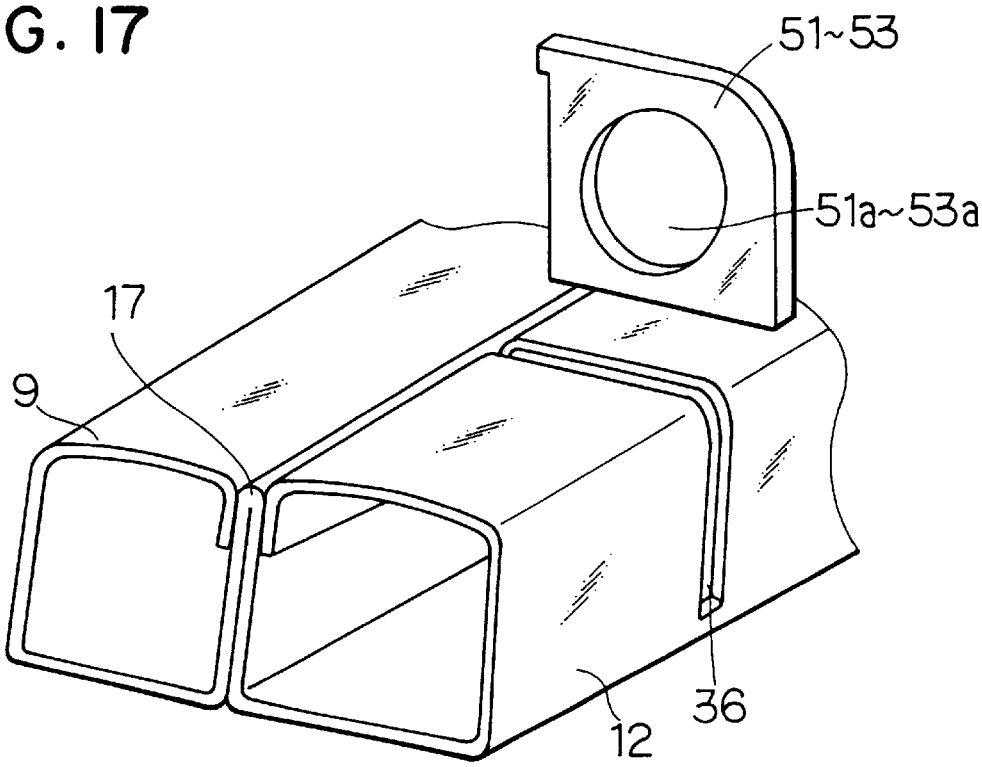
FIG. 17 is a disassembled perspective view showing a throttle plate and the tank portions according to the first embodiment.

FIG. 17 shows an assembling structure of each throttle plate 51–53 into the tank portions 9, 12. As shown in FIG. 17, a slit groove 36 into which each of the throttle plates 51–53 is inserted is provided at an appropriate position in the lower tank portions 9, 12. Each of the throttle plates 51–53 is formed by a both-side clad aluminum plate which is obtained by applying brazing material (A4000) on both side surfaces of an aluminum core plate (A3000). In this case, by inserting the throttle plates 51–53 into predetermined slit grooves 36, respectively, the throttle plates 51–53 are bonded to the lower side tank portions 9, 12 using the brazing material on the throttle plates 51–53 and the brazing material on the inner surface of the lower tank portions 9, 12.

According to the first embodiment of the present invention, the tank portions 8–13 and the tubes 2–5 are formed separately, and then integrally connected with each other. Therefore, the thickness of the tank portions 8–13 can be increased so that the tank portions 8–13 are reinforced, while the thickness of the tubes 2–5 is sufficiently decreased so that minuteness between the tubes 2–5 and the corrugated fins 19 is improved. As a result, the evaporator 1 becomes compact and has a sufficient cooling performance.

Further, the upper tank portions 8, 10, 11, 13 are formed by bending a single aluminum thin plate, and the lower tank portions 9, 12 are formed by bending a single aluminum thin plate. Therefore, brazing material does not need to be applied on an outer surface of the aluminum thin plate for forming the tank portions 8–13, thereby improving anticorrosion performance of the tank portions 8–13.

Similarly, brazing material also does not need to be applied on an outer surface of the tubes 2–5, thereby improving anticorrosion performance of the tubes 2–5. Further, since no brazing material is applied on the outer surface of the tubes 2–5, a surface treated layer of the tubes 2–5 is efficiently formed. As a result, water-draining performance on the evaporator 1 is improved, thereby restricting the evaporator 1 from generating unpleasant smell.

Further, the corrugated fins 19 are not applied with brazing material, either. Therefore, a surface treated layer of the corrugated fins 19 is also efficiently formed. As a result, water-draining performance on the evaporator 1 is improved, thereby restricting the evaporator 1 from generating unpleasant smell.

A second preferred embodiment of the present invention will be described with reference to FIG. 18. In the second embodiment, components which are similar to those in the first embodiment are indicated with the same reference numerals, and the explanation thereof is omitted. In the above-described first embodiment, the inlet 6 and the outlet 7 are disposed at the upper left side of the evaporator 1. However, in the second embodiment, the refrigerant inlet 6 and the outlet 7 are disposed at a lower left side of an evaporator 1. Specifically, the refrigerant inlet 6 is provided to communicate with the left-side part of the lower inlet-side tank portion 9, and the outlet 7 is provided to communicate with the left side part of the lower outlet-side tank portion 12.

With the arrangement variation of the inlet 6 and the outlet 7, the throttle plates 14, 15 are disposed within the lower tank portions 9, 12, and the communication holes 18 are also provided in the partition wall 17 at the lower side. Further, in the second embodiment, a single throttle plate 51 having a throttle hole 51*a* is disposed between the inlet 6 and the partition plate 14 within the lower tank portion 9.

According to the second embodiment of the present embodiment, refrigerant flowing from the inlet 6 into the left part of the tank portion 9 is distributed into the tubes 2, flows through the tubes 2 upwardly as shown by an arrow "m", and flows into the upper tank portion 8. Refrigerant in the upper tank portion 8 further flows into the upper tank portion 10. Thereafter, refrigerant in the upper tank portion 10 is distributed into the tubes 3, flows through the tubes 3 downwardly as shown by an arrow "n", and flows into the right part of the lower tank portion 9. Then, refrigerant flowing into the right part of the lower tank portion 9 passes through the communication holes 18, and flows into the right part of the lower tank portion 12. That is, refrigerant moves from the inlet-side heat exchange portion X to the outlet-side heat exchange portion Y through the communication holes 18.

Next, refrigerant is distributed from right part of the lower tank portion 12 into the tubes 5, flows through the tubes upwardly as shown by an arrow "o", and flows into the upper tank portion 11. Thereafter, refrigerant flows from the upper tank portion 11 into the upper tank portion 13. Then, refrigerant is distributed from the upper tank portion 13 into the tubes 4, and flows through the tubes 4 downwardly as shown by an arrow "p". Further, refrigerant is collected within the left part of the lower tank portion 12 from the tubes 4, and flows to an outside of the evaporator 1 from the outlet 7.

Figure 18:
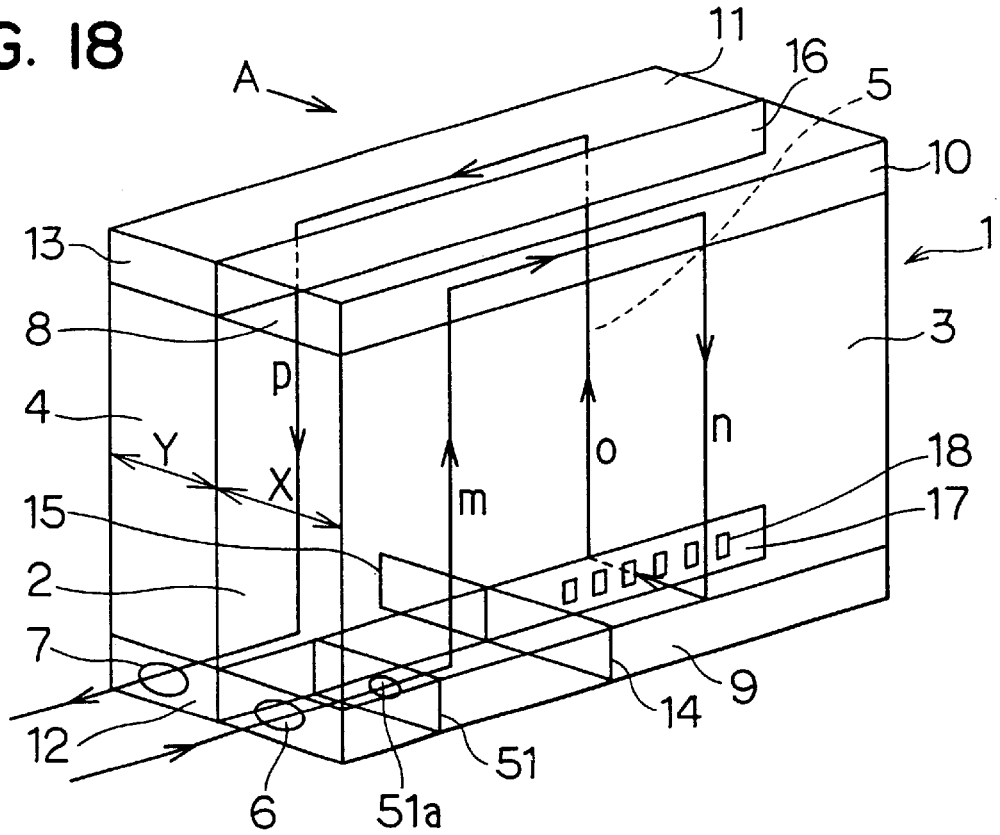
FIG. 18 is a schematic perspective view showing a refrigerant flow passage of an evaporator according to a second preferred embodiment of the present invention.
Figure 19:
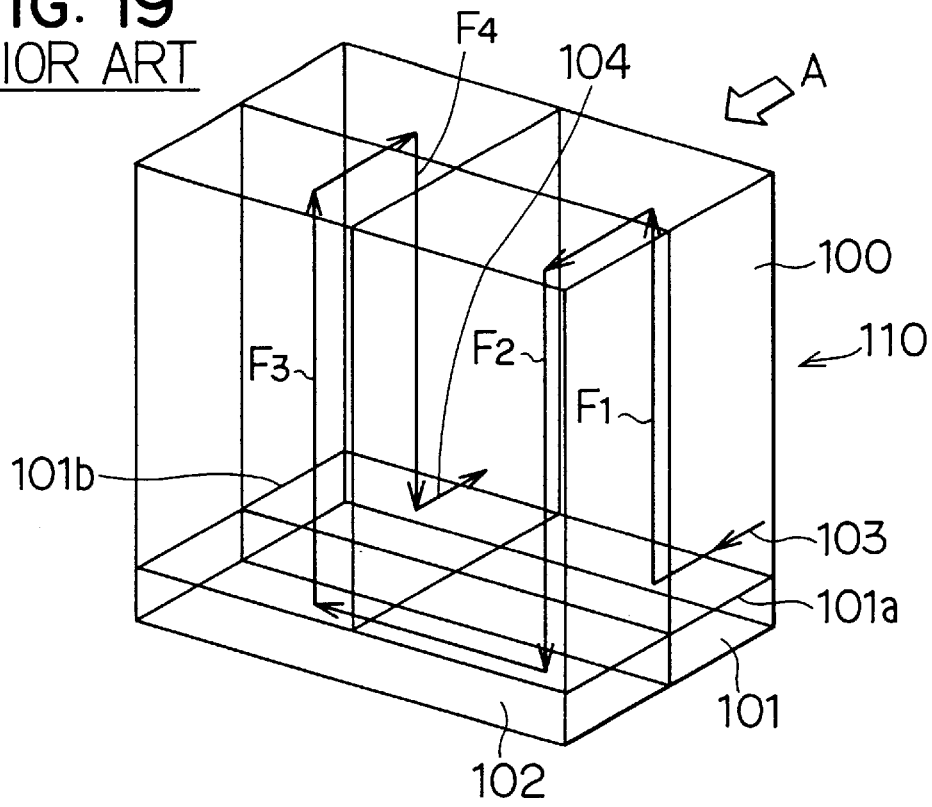
FIG. 19 PRIOR ART
FIG. 19 is a schematic perspective view showing a conventional evaporator.
Figure 20:
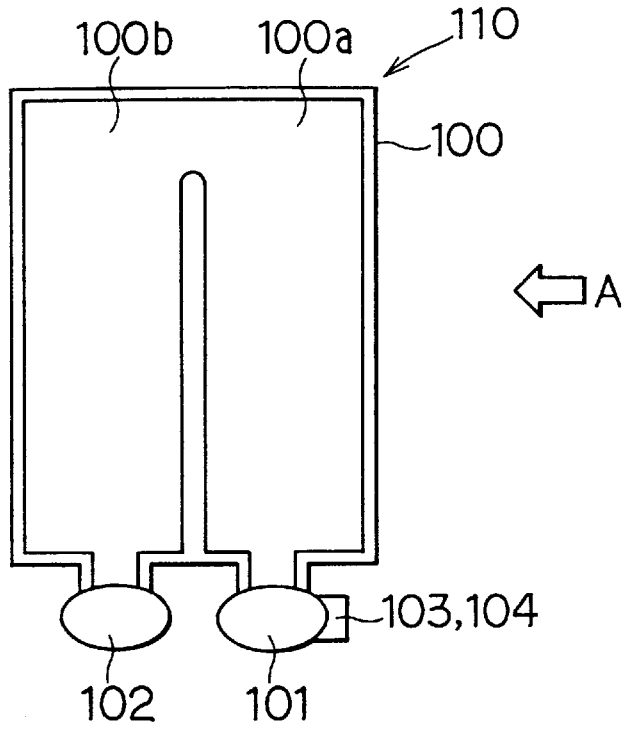
FIG. 20 PRIOR ART
FIG. 20 is a schematic sectional view of the conventional evaporator in FIG. 19.

While refrigerant is distributed from the upper tank portion 13 into the tube 4, much of liquid refrigerant flows into the right side in FIG. 18 of the tubes 4 by gravity, and distribution of liquid refrigerant becomes nonuniform. In the second embodiment, the distribution of liquid refrigerant flowing through the tubes 2 is adjusted by the throttle hole 51*a* of the throttle plate 51 so that the distribution of liquid refrigerant within the tubes 2 disposed at the downstream air side of the tubes 4 is made opposite to that within the tube 4. Therefore, the temperature distribution of air passing through the overlapped tubes 4, 2 in the air flowing direction A is made uniform.

On the other hand, while refrigerant is distributed from the upper tank portion 10 into the tubes 3, much of liquid refrigerant flows into left side in FIG. 18 of the tubes 3 by gravity, and distribution of liquid refrigerant becomes nonuniform in the tubes 3. In the second embodiment, the distribution of liquid refrigerant within the tubes 5 is adjusted by suitably setting the opening areas and the arrangement positions of the plural communication holes 18. Therefore, the temperature distribution of air passing through the overlapped tubes 5, 3 in the air flowing direction A is made uniform.

Although the present invention has been fully described in connection with the preferred embodiments thereof with reference to the accompanying drawings, it is to be noted that various changes and modifications will become apparent to those skilled in the art.

For example, in the above-described first embodiment, the three throttle holes 51*a*–53*a* are provided within each of the inlet-side tank portion 9 and the outlet-side tank portion 12. However, one or more throttle holes may be provided in accordance with a request of the refrigerant distribution. Further, the throttle holes 51*a*–53*a* may be made elliptical, rectangular or in the like. In the above-described first embodiment, throttle plates 51–53 having the throttle holes 51*a*–53*a* are provided in the tank portions 9, 12. However, a throttle may be formed in the tank portions by thinning the tank portions, for example. Further, at least one throttle is throttled to have a throttle area equal to or lower than 80% of a tank sectional area of the tank portions.

In the above-described embodiments, the present invention is applied to a refrigerant evaporator completely vertically disposed. However, the present invention may be applied to an inclined evaporator.

In the above-described first embodiment, both the tank portions 10, 11 communicate with each other through the communication holes 18 provided in the partition wall 16. However, both the tank portions 10, 11 may communicate with each other through a refrigerant side-passage provided at the side (the right side in FIG. 1) of the evaporator 1, instead of the communication holes 18.

In the above-described embodiments, the inlet-side heat exchange portion x may be disposed at an upstream air side of the outlet-side heat exchange portion Y in the air flowing direction. Further, the present invention can be applied to a refrigerant evaporator wherein the heat exchange portions X, Y are disposed in three or more rows in the air flowing direction A.

Such changes and modifications are to be understood as being within the scope of the present invention as defined by the appended claims.

What is claimed is:

1. An evaporator for performing heat exchange between refrigerant flowing therethrough and outside fluid flowing outside said evaporator, said evaporator comprising:

a first upstream core having a plurality of first upstream tubes through which refrigerant flows in a longitudinal direction of said first upstream tubes, said first upstream tubes being arranged parallel to each other in a line in a width direction perpendicular to both of a flow direction of said outside fluid and said longitudinal direction of said first upstream tubes;

a second upstream core adjacent said first upstream core in said width direction, said second upstream core having a plurality of second upstream tubes through which refrigerant flows in a longitudinal direction of said second upstream tubes, said first and second upstream tubes being arranged parallel to each other in a line in said width direction;

a first downstream core disposed at a direction downstream side of said first upstream core in said flow direction of said outside fluid, said first downstream core having a plurality of first downstream tubes through which refrigerant flows in a longitudinal direction of said first downstream tubes, said first downstream tubes being arranged parallel to each other in a line in said width direction;

a second downstream core disposed at a direct downstream side of said second upstream core in said flow direction of said outside fluid to be adjacent to said first downstream core in said width direction, said second downstream core having a plurality of second downstream tubes through which refrigerant flows in a longitudinal direction of said second downstream tubes, said first and second downstream tubes being arranged parallel to each other in a line in said width direction;

first and second upstream tanks for distributing refrigerant into said first and second upstream tubes and for collecting refrigerant from said first and second upstream tubes, said first upstream tank being connected to one longitudinal end of said first and second upstream tubes, and said second upstream tank being connected to the other longitudinal end of said first and second upstream tubes; and first and second downstream tanks for distributing refrigerant into said first and second downstream tubes and for collecting refrigerant from said first and second downstream tubes, said first downstream tank being connected to one longitudinal end of said first and second downstream tubes, and said second downstream tank being connected to the other longitudinal end of said first and second downstream tubes, wherein:

said first downstream tank connected to said first downstream tubes of said first downstream core has an inlet for introducing refrigerant at an end side in said width direction, and said first upstream tank connected to said first upstream tubes of said first upstream core has an outlet for discharging refrigerant at said end side in said width direction;

said first downstream tank connected to said second downstream tubes of said second downstream core and said first upstream tank connected to said second upstream tubes of said second upstream core have a plurality of communication holes through which said first downstream tank and said first upstream tank communicate with each other;

said second downstream tank connected to said second downstream tubes, has therein a throttle for reducing a refrigerant passage area; and said first and second downstream tanks and said first and second upstream tanks are disposed in such manner that refrigerant introduced from said inlet flows through said first downstream tank connected to said first downstream tubes, said first downstream tubes, said second downstream tank, said second downstream tubes, said first downstream tank connected to said second downstream tubes, said communication holes, said first upstream tank, and is discharged to an outside from said outlet.

2. The evaporator according to claim 1, wherein said second upstream tank connected to said first upstream tubes has therein a throttle for reducing a refrigerant passage area.

3. The evaporator according to claim 1, wherein:

said first upstream tank and said first downstream tank are disposed at an upper side of each tube; and said second upstream tank and said second downstream tank are disposed at a lower side of each tube.

4. The evaporator according to claim 1, wherein in said first upstream core and said first downstream core, a flow direction of refrigerant flowing through said first upstream tubes is opposite to that of refrigerant flowing through said first downstream tubes; and in said second upstream core and said second downstream core, a flow direction of refrigerant flowing through said second upstream tubes is opposite to that of refrigerant flowing through said second downstream tubes.

5. The evaporator according to claim 1, further comprising;

a partition wall for partitioning adjacent first upstream and downstream tanks adjacent to each other in the flow direction of the outside fluid, wherein said partition wall has said communication holes arranged in the width direction.

6. The evaporator according to claim 5, wherein the number of communication holes is equal to that of said second downstream tubes connected to said downstream tank.

7. The evaporator according to claim 1, wherein said throttle includes plural throttle plates having throttle holes.

8. The evaporator according to claim 1, wherein said tubes and said tanks are integrally connected to each other after being separately formed.

9. An evaporator for performing heat exchange between refrigerant flowing therethrough and outside fluid flowing outside the evaporator, the evaporator comprising:

a plurality of upstream tubes through which refrigerant flows in a longitudinal direction of each upstream tube, said upstream tubes being arranged parallel to each other in a line in a width direction perpendicular to both of a flow direction of the outside fluid and the longitudinal direction of said upstream tubes, a plurality of downstream tubes through which refrigerant flows in the longitudinal direction, said downstream tubes being arranged parallel to each other in a line in the width direction at a downstream side of said upstream tubes in the flow direction of the outside fluid;

an upstream tank for distributing refrigerant into said upstream tubes and for collecting refrigerant from said upstream tubes, said upstream tank being connected to both longitudinal ends of each upstream tube;

a downstream tank for distributing refrigerant into said downstream tubes and for collecting refrigerant from said downstream tubs, said downstream tank being connected to both longitudinal ends of each downstream tube; and a throttle disposed within at least one of said upstream tank and said downstream tank, for reducing a refrigerant passage area, wherein:

any one of said upstream tank and said downstream tank has an inlet for introducing refrigerant at a side end in the width direction, and the other one of said upstream tank and said downstream tank has an outlet for discharging refrigerant at a side end in the width direction;

in both said upstream and downstream tubes relative to the flow direction of the outside fluid, flow directions of refrigerant are opposite to each other;

said upstream tank and said downstream tank define a collection portion to which refrigerant from said tubes is collected, and a distribution portion from which refrigerant is distributed into said tubes;

said throttle is disposed at least in said distribution portions;

said throttle includes plural throttle plates having throttle holes; and said throttle plates are disposed at predetermined positions, from a boundary between said collection portion and said distribution portion in the width direction, toward a downstream refrigerant side.

10. The evaporator according to claim 9, further comprising:

a first partition wall extending in the width direction, for defining said upstream tank and said downstream tank; and a second partition wall for partitioning said upstream and downstream tanks into a first tank portion and a second tank portion, respectively, in the width direction, wherein:

said inlet and said outlet are provided in said first tank portion at the same side in the width direction and in the longitudinal direction of said tubes; and said first partition wall has communication holes provided at positions corresponding to tubes connected to said second tank portion.

11. The evaporator according to claim 10, wherein the number of said communication holes is equal to that of said tubes in one row, connected to said second tank portion.

12. The evaporator according to claim 9, wherein said inlet is provided at said downstream tank, and said outlet is provided at said upstream tank.

* * * * *